United States Patent [19]

Ohishi

[11] Patent Number: 4,586,349

[45] Date of Patent: May 6, 1986

[54] UNITARY AIR CONDITIONER

[75] Inventor: Kenji Ohishi, Shizuoka, Japan

[73] Assignee: Mitsubishi Denki Kabushiki Kaisha, Tokyo, Japan

[21] Appl. No.: 642,842

[22] Filed: Aug. 21, 1984

[30] Foreign Application Priority Data

Nov. 2, 1983 [JP] Japan ..... 58-170805[U]
Nov. 2, 1983 [JP] Japan ..... 58-170798[U]
Dec. 9, 1983 [JP] Japan ..... 58-189919[U]

[51] Int. Cl.[4] ..... F25D 19/00
[52] U.S. Cl. ..... 62/296; 98/94.2
[58] Field of Search ..... 98/94.2; 62/262, 263

[56] References Cited

U.S. PATENT DOCUMENTS 3,576,114 4/1971 Sharp et al. ..... 62/262
3,783,637 1/1974 Woods ..... 62/262 X
4,205,597 6/1980 Nawa et al. ..... 62/262 X

FOREIGN PATENT DOCUMENTS 591469 8/1947 United Kingdom .
768427 2/1957 United Kingdom .
1400550 7/1975 United Kingdom .
1401834 7/1975 United Kingdom .

*Primary Examiner*—William E. Wayner
*Attorney, Agent, or Firm*—Sughrue, Mion, Zinn, Macpeak, and Seas

[57] ABSTRACT

A unitary air conditioner including a compressor, a chiller coil, a condenser, an indoor fan and an outdoor fan provided on a common base. An outdoor cabinet accommodates the compressor, condenser and outdoor fan. An indoor cabinet accommodates the chiller coil and the indoor fan. The outdoor cabinet has a first noise shielding member facing the indoor cabinet for shielding the noise produced in the outdoor cabinet. The indoor cabinet has a second noise shielding member facing the first noise shielding member for preventing propagation of the noise into the indoor cabinet. The first and second noise shielding members are spaced apart from each other to separate the outdoor and indoor cabinets, which are mounted on the base.

8 Claims, 10 Drawing Figures

UNITARY AIR CONDITIONER

BACKGROUND OF THE INVENTION

The present invention relates to an improved unitary air conditioner having an indoor unit and an outdoor unit provided on a single base.

A unitary air conditioner is disclosed in Japanese Utility Model Publication No. 53313/1982, and shown in FIGS. 1 to 3. This air conditioner includes a main body 4 incorporating both an indoor unit 2 and an outdoor unit 3, which are separated from each other by a partition 1 fixed to a common base 5. The indoor unit 2 includes a chiller coil 6 and a squirrel cage fan 7 which are mounted on the base 5. The outdoor unit 3 includes a condenser 8, a compressor 9, a fan motor 10 and a propeller fan 11, which are mounted on the base 5. When the air conditioner is installed, a cabinet 12 is mounted in a wall (not shown) of the building, the base 5 carrying the indoor and outdoor units 2 and 3 thereon is placed in the cabinet 12, and a front panel 13 is attached to the main body 4.

The air conditioner as hereinabove described has, however, the disadvantage that the noise produced by the compressor 9 and the motor 10 in operation is transmitted to the interior of the room for which the air conditioner is installed since only a single partition 1 is provided between the indoor and outdoor units 2 and 3.

SUMMARY OF THE INVENTION

Taking the above into consideration, it is a first object of this invention to provide a unitary air conditioner which is very simple in construction and yet restricts the propagation of noise from the outdoor unit to the interior of the room which the air conditioner is employed to cool. In accordance with the invention, the above object is attained by disposing two spaced apart partitions between the indoor and outdoor units so that the noise from the outdoor unit is diffused between the two partitions.

It is a second object of the invention to provide a unitary air conditioner which provides an improved indoor environment by diffusing outdoors the noise of the outdoor unit and preventing its propagation into the interior of the room. This object is attained by mounting the indoor and outdoor units in a mutually spaced apart relationship on a base and providing the indoor unit with a front surface facing the interior of the room and exceeding in dimensions the wall opening in which the air conditioner is installed.

It is a third object of this invention to provide a unitary air conditioner including two spaced apart partition plates disposed between an indoor unit having a chiller coil and an outdoor unit including a compressor, and a main body accommodating the indoor and outdoor units mounted in a wall opening and having on its front edge a projection facing the periphery of the wall opening.

DESCRIPTION OF THE PREFERRED EMBODIMENTS

Figure 1:
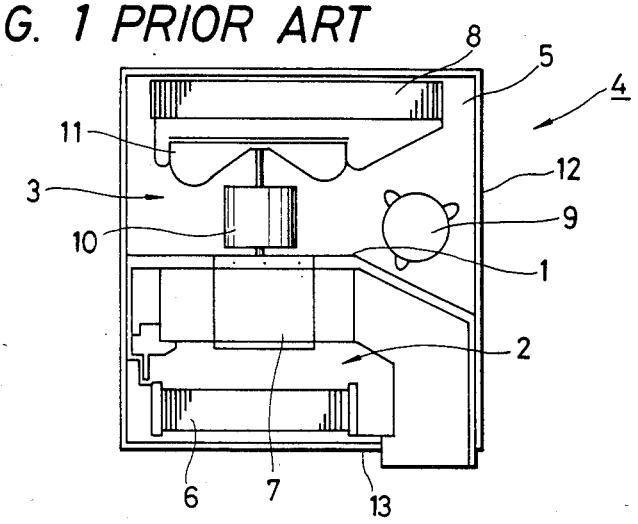
FIG. 1 PRIOR ART
FIG. 1 is a top plan view of a conventional unitary air conditioner.
Figure 2:
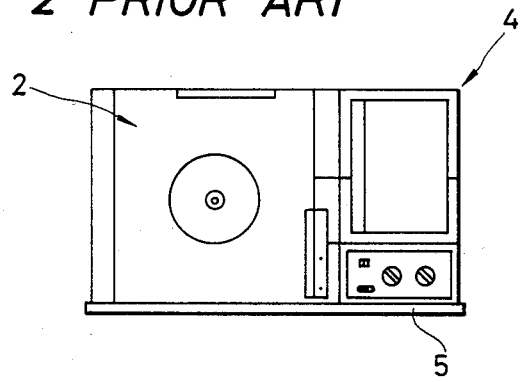
FIG. 2 PRIOR ART
FIG. 2 is a front elevational view of the air conditioner shown in FIG. 1, excluding its front panel.
Figure 3:
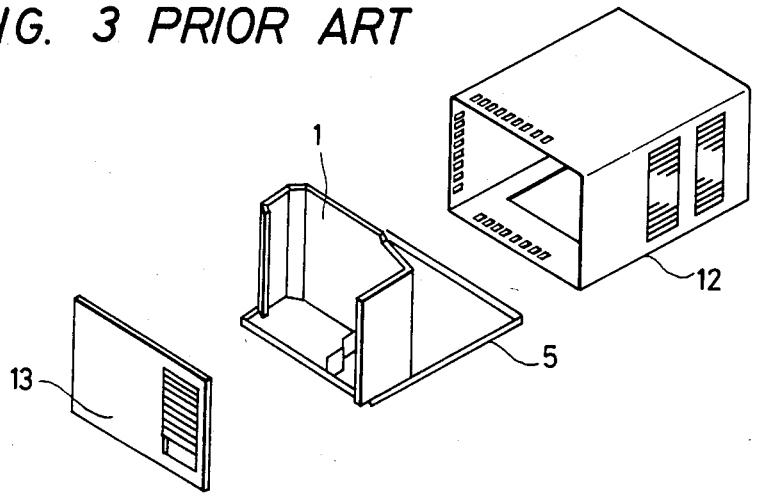
FIG. 3 PRIOR ART
FIG. 3 is an exploded perspective view of the air conditioner shown in FIG. 1, excluding its internal mechanism.
Figure 4:
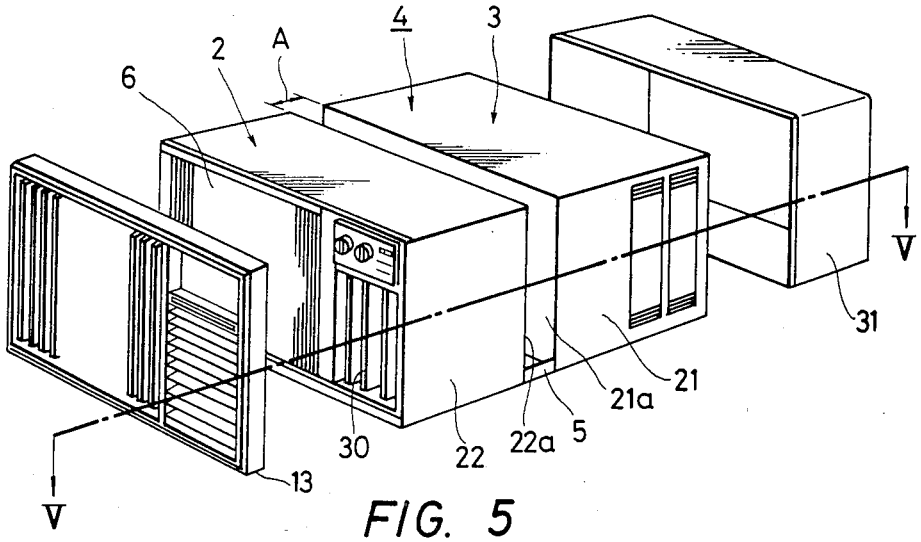
FIG. 4 is an exploded perspective view of a unitary air conditioner according to a first embodiment of this invention.
Figure 5:
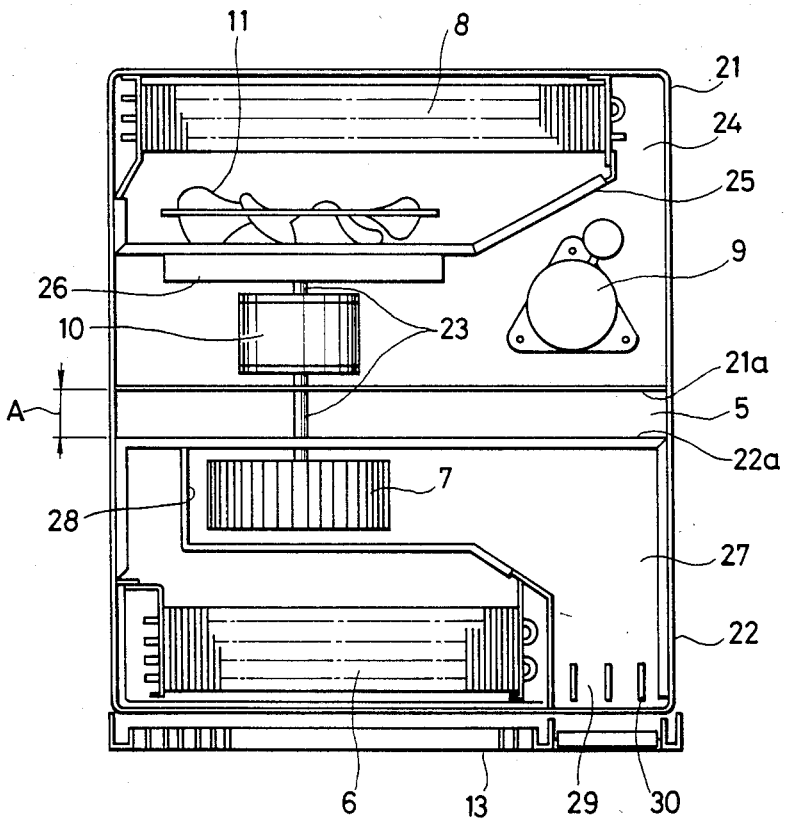
FIG. 5 is a sectional view taken along a line V—V of FIG. 4.

A first embodiment of the invention is shown in FIGS. 4 and 5. Some of the parts of the air conditioner duplicate those in the apparatus of FIGS. 1 to 3 and are designated by the same reference numerals used therein, and thus will not be described in any further detail.

An outdoor cabinet 21 for the outdoor unit 3, provided on the base 5 for the main body 4, accommodates the condenser 8, compressor 9, fan motor 10 and propeller fan 11. An indoor cabinet 22 for the indoor unit 2 is also provided on the base 5, and accommodates the cooler 6 and the squirrel cage fan 7 secured to a motor shaft 23 extending from the fan motor 10. Two plates **21*a* and 22*a*, which are spaced apart from each other as shown at A, define the back walls of the outdoor and indoor cabinets 21 and 22, respectively. The back plates 21*a* and 22*a* define therebetween an open space for diffusing outdoors the operating noise of the compressor 9 and the fan motor 10, the noise of rotation of the propeller fan 11, and the splashing noise of the drain. A vent passage 24 is provided between a fan cover 25 and a bellmouth 26 and the outdoor cabinet 21. A vent passage 27, provided between a casing 28 and the indoor cabinet 22, is connected to an air outlet 29. Vanes 30 are provided at the outlet 29 of the vent passage 27. Reference numeral 31** denotes a mounting frame which is disposed in a wall.

Even if the operating noise of the compressor 9 and the fan motor 10 is propagated outwardly of the outdoor cabinet 21, it is diffused by the space between the back places **21*a* and 22*a* and does not reach the interior of the indoor cabinet 22** or the room.

Figure 6:
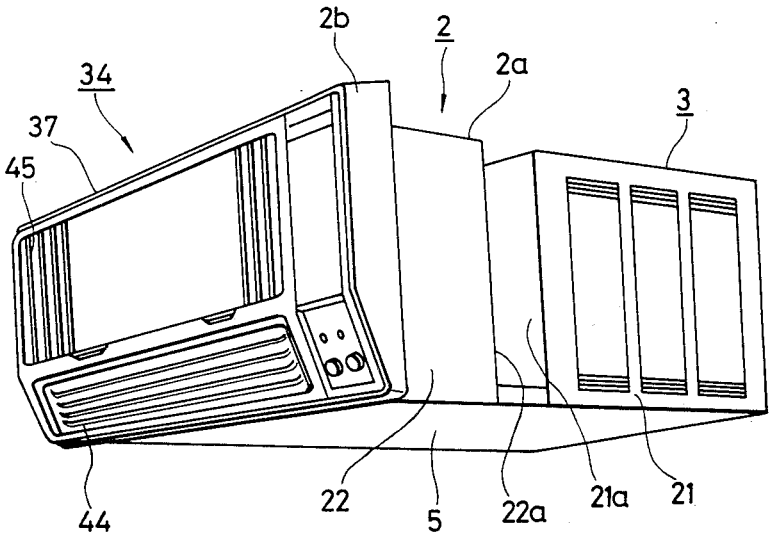
FIG. 6 is a perspective view of a unitary air conditioner according to a second embodiment of this invention.
Figure 7:
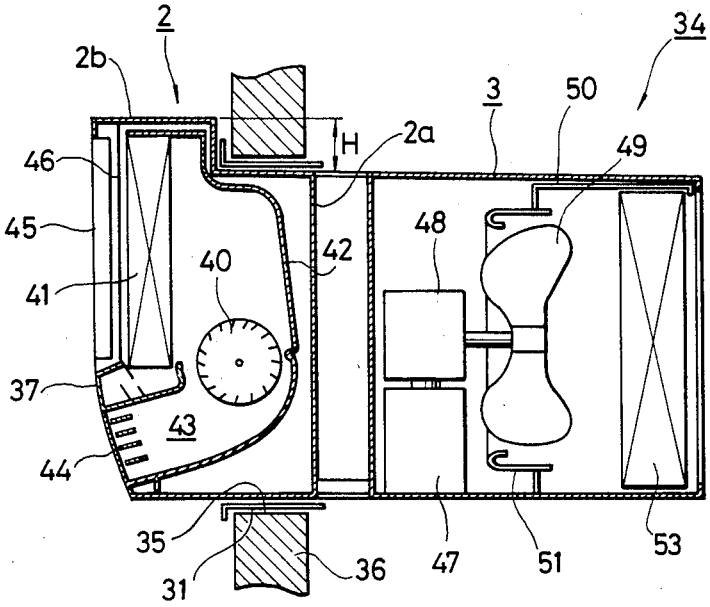
FIGS. 7 and 8 are vertical and horizontal sectional views, respectively, of the air conditioner shown in FIG. 6.
Figure 8:
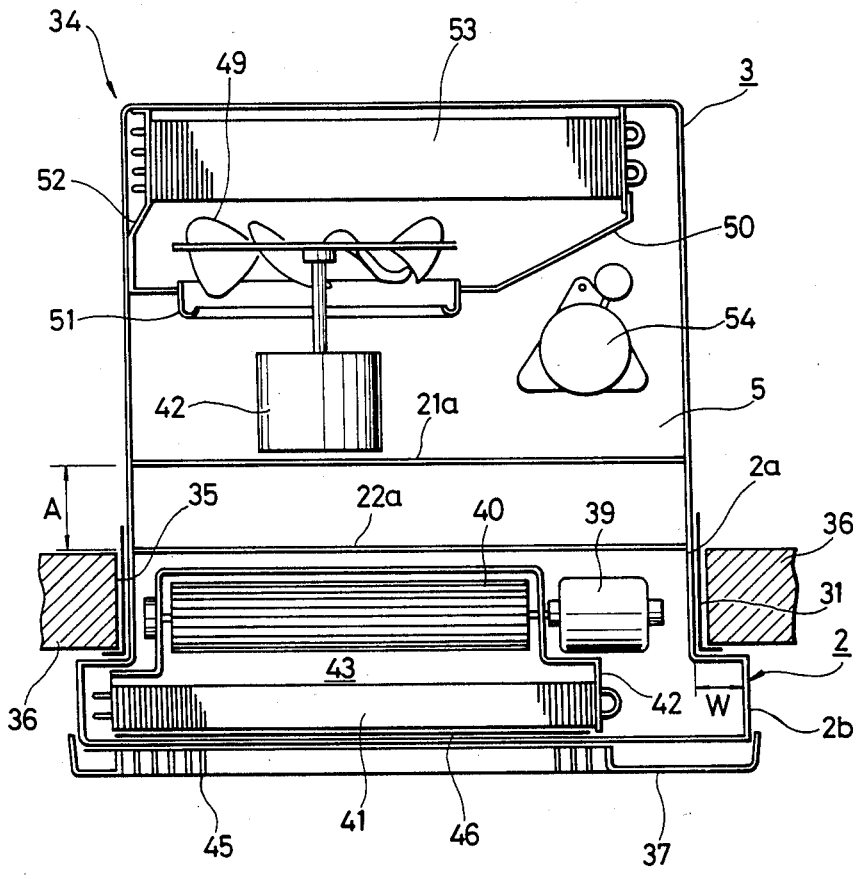

A second embodiment of the invention in shown in FIGS. 6 to 8. Like reference numerals are used to designate like parts throughout FIGS. 4 to 8. An indoor unit 2 and an outdoor unit 3 are secured on a single base plate 5 and spaced apart from each other as shown at A. The indoor unit 2 of a unitary air conditioner 34 has a rear portion **2*a* fitted in a wall opening 35 and secured to a wall 36. The indoor unit 2 has a front portion 2*b* disposed in the interior of the room, projecting beyond the top and both sides of the rear portion 2*a* as shown at H and W. The front portion 2*b* has a front opening closed by a front panel 37, which is likewise larger than the rear portion 2*a*. A mounting frame 31 is fitted in the wall opening 35, and the cabinet for the indoor unit 2 is secured to the frame 31**.

The cabinet for the indoor unit 2 accommodates a line flow fan 40, connected directly to a motor 39, and a chiller coil 41. The fan 40 and the chiller coil 41 are disposed in an air passage 43 defined by a casing 42. The front panel 37 is provided with an outlet 44 for the air passage 43 and a suction grill 45. A filter 46 is disposed between the chiller coil 41 and the grill 45.

The cabinet for the outdoor unit 3 includes a motor base 47 secured to the base 5. A motor 48 is secured to the motor base 47 and a propeller fan 49 is connected directly to the motor 48. A bellmouth 51 forms an integral part of a fan cover 50 secured to the base 5 and is concentric to the propeller fan 49. A supporting member 52 forms an integral part of the fan cover 50 and supports a condenser 53. A compressor 54 is connected by pipes between the chiller coil 41 and the condenser 53.

Refrigerant compressed by the compressor 54 and having a high temperature and a high pressure is liquefied as it is cooled by the air from the propeller fan 49 when passing through the condenser 53, while the cooling air is discharged to the exterior of the room. The liquefied cooling medium passes through the chiller coil 41 and cools warm air in the room by removing heat therefrom as it is drawn through the grill 45 by the line flow fan 40. The refrigerant is thus gasified and returned to the compressor 54. The cooled air is blown through the outlet 44 into the room.

Although noise may be generated outdoors by he rotation of the motor 48, the propeller fan 49, the compressor 54 or the splashing drain, it is diffused outdoors and does not reach the interior of the room since the back plates 21*a* and 22*a* of the two units 2 and 3 are completely separated from each other as shown at A. This effect is further promoted by the front portion 2*b* of the indoor unit 2 which is larger than the wall opening 35.

Figure 9:
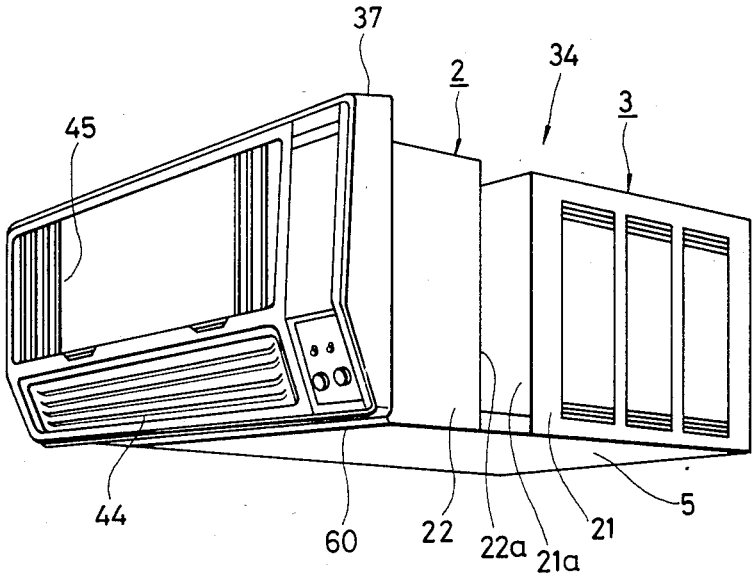
FIG. 9 is a perspective view of a unitary air conditioner according to a third embodiment of this invention.
Figure 10:
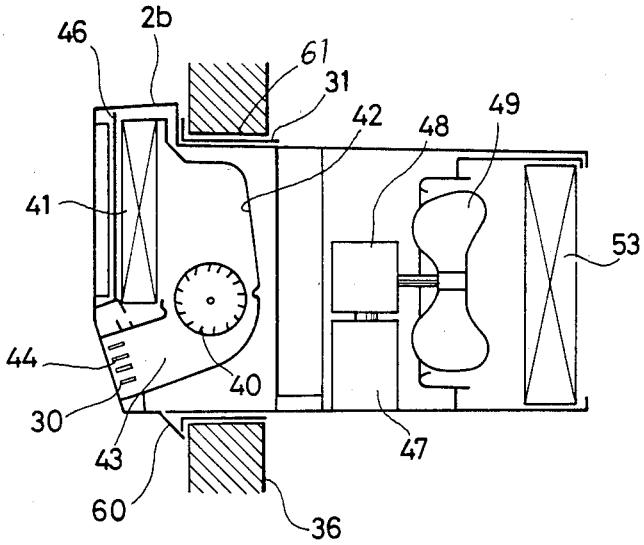
FIG. 10 is a vertical sectional view of the air conditioner shown in FIG. 9.

A third embodiment of the invention is shown in FIGS. 9 and 10. This embodiment is substantially identical to the second embodiment except for the provision of a rib 60 at the bottom of the front panel 37. Like reference numerals are used to designate like parts throughout FIGS. 6 to 10. The rib 60 is provided for closing the bottom of an opening 61 in a wall 36. The rib 60 is equal in width to the front panel 37 and forms an integral part thereof. The rib 60 restricts the propagation of noise into the interior of the room through the bottom of the wall opening 61, shuts off any air leaking into the room, and provides an improved appearance for the air conditioner.

I claim:

1. A unitary air conditioner having a compressor, a chiller coil, a condenser, an indoor fan and an outdoor provided on a common one-piece base, said air conditioner comprising:

an outdoor cabinet accommodating said compressor, said condenser and said outdoor fan; and an indoor cabinet accommodating said chiller coil and said indoor fan, said outdoor cabinet having a first noise shielding member facing said indoor cabinet for shielding noise produced in said outdoor cabinet, said indoor cabinet having a second noise shielding member facing said first noise shielding member for preventing propagation of said noise into said indoor cabinet, said first and second noise shielding members being spaced apart from each other to space apart from each other said outdoor and indoor cabinets, which are mounted on said one-piece base, wherein said cabinets define therebetween an open space exposed to outdoor air and having a bottom closed by said base.

2. The air conditioner as set forth in claim 1, further comprising a mounting frame sized as to provide an open space between said outdoor and indoor cabinets.

3. The air conditioner as set forth in claim 1, further comprising a motor provided in said outdoor cabinet for rotating said outdoor fan.

4. The air conditioner as set forth in claim 1, wherein said cabinets define therebetween an open space having a bottom closed by said base.

5. The air conditioner as set forth in claim 1, wherein an indoor unit including said indoor cabinet has a front portion facing indoors, said front portion being larger than a wall opening in which said air conditioner is installed.

6. The air conditioner as set forth in claim 5, further comprising a member provided at a bottom of said front portion for closing a clearance forming a portion of said wall opening.

7. The air conditioner as set forth in claim 6, wherein said closing member is a rib forming an integral part of said front portion.

8. The air conditioner as set forth in claim 1, further comprising a motor provided in said indoor cabinet for driving said indoor fan, said motor being independent of a motor for said outdoor fan.

* * * * *